US008818218B2

(12) United States Patent
Naka et al.

(10) Patent No.: US 8,818,218 B2
(45) Date of Patent: Aug. 26, 2014

(54) PHOTOSENSOR AND IMAGE FORMING DEVICE INCORPORATING THE SAME

(75) Inventors: Sohichiroh Naka, Zama (JP); Toshio Yanata, Ebina (JP); Masahiko Sato, Sagamihara (JP); Masataka Akaishi, Ebina (JP); Masafumi Hashiguchi, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 94 days.

(21) Appl. No.: 13/539,774

(22) Filed: Jul. 2, 2012

(65) Prior Publication Data

US 2013/0022363 A1 Jan. 24, 2013

(30) Foreign Application Priority Data

Jul. 21, 2011 (JP) ..... 2011-160352

(51) Int. Cl.
*G03G 15/00* (2006.01)

(52) U.S. Cl.
USPC ..... 399/49; 399/74

(58) Field of Classification Search
USPC ..... 399/49, 72, 74, 107
See application file for complete search history.

(56) References Cited

U.S. PATENT DOCUMENTS

| | | | | |
|---|---|---|---|---|
| 7,821,677 | B2 * | 10/2010 | Tanaka et al. | 358/474 |
| 2008/0198566 | A1 * | 8/2008 | Minota et al. | 361/767 |

FOREIGN PATENT DOCUMENTS

| | | |
|---|---|---|
| JP | 5-91245 | 4/1993 |
| JP | 2003-40488 | 2/2003 |
| JP | 2008-261864 | 10/2008 |
| JP | 2010-40006 | 2/2010 |
| JP | 2010-123875 | 6/2010 |

* cited by examiner

*Primary Examiner* — Hoang Ngo
(74) *Attorney, Agent, or Firm* — Oblon, Spivak, McClelland, Maier & Neustadt, L.L.P.

(57) ABSTRACT

A photosensor includes a light emitting element to emit light to a target object, a light receiving element to receive the light emitted from the light emitting element and reflected by the target object, and a circuit board on which the light emitting element and the light receiving element are mounted, including at least one protrusion thereon. The light emitting element and the light receiving element each have a terminal. The at least one protrusion is configured to support one of the light emitting element and the light receiving element in a contact manner in a state that the terminal is electrically connected to the circuit board.

7 Claims, 11 Drawing Sheets

PHOTOSENSOR AND IMAGE FORMING DEVICE INCORPORATING THE SAME

CROSS REFERENCE TO RELATED APPLICATION

The present application is based on and claims priority from Japanese Patent Application No. 2011-160352, filed on Jul. 21, 2011, the disclosure of which is hereby incorporated by reference in its entirety.

BACKGROUND OF THE INVENTION

1. Field of the Invention

The present invention relates to a photosensor to emit light to a target object and receive light reflected thereby as well as to an image forming device such as a copier, a printer or a facsimile machine incorporating such a photosensor.

2. Description of the Related Art

Some image forming device having a photosensor generates a toner patch as a referential pattern on the surface of an image carrier and detects the density of the toner patch for the purpose of realizing stable image density. To control image density, such an image forming device adjusts develop potential by changing charge bias, developing bias, and light intensity for forming an electric latent image or adjusts a target toner density of two-component developer in a develop unit on the basis of a detected result of the photosensor. This type of photosensor is generally a reflective photosensor having a light emitting element and a light receiving element.

Japanese Patent Application Publication No. 2008-261864 discloses a photosensor including light emitting and light receiving elements of a surface mount type on a printed circuit board. There are two types of light emitting element, a top view surface mount type to emit light to a printed circuit board orthogonally, and a side view surface mount type to emit light thereto in parallel. Likewise, a top view surface mount type light receiving element receives light orthogonally relative to the printed circuit board while a side view surface mount type light receiving element receives light in parallel to the printed circuit board. The same type of light emitting element and light receiving element are used together.

These light emitting element and light receiving element (hereinafter, referred to as simply element when appropriate) are each provided with L-shaped output terminal and input terminal composed of one portion extending to the printed circuit board and the other portion continuing from the end of the one portion and extending in parallel to the printed circuit board. To mount each of the elements on the surface of the printed circuit board, the other parallel portions of the terminals and the connecting portions of the printed circuit board are joined by soldering.

In fixing the element on the printed circuit board by soldering, only the pair of input and output terminals is placed thereon. That is, the element is supported by the two terminals only when mounted. This may cause a problem that the element is mounted in an unintended posture on the circuit board. For example, such a problem occurs when the extending portion and the parallel portion of the terminal make an angle other than a preset angle of 90 degrees due to a processing error. Further, there is a gap between the circuit board and the opposing surface of the element so that the element supported by the two terminals may be swayed about the terminals as fulcrum in the gap. Because of this, while melted solder between the connecting portions of the circuit board and the terminals is being hardened, the elements may be touched and swayed to partially contact the printed circuit board, and fixed thereto in an inclined posture.

SUMMARY OF THE INVENTION

The present invention aims to provide a photosensor including a light emitting element and a light receiving element properly mounted in a certain posture on a circuit board as well as an image forming device incorporating such a photosensor.

According to one aspect of the present invention, a photosensor includes a light emitting element to emit light to a target object, a light receiving element to receive the light emitted from the light emitting element and reflected by the target object, and a circuit board on which the light emitting element and the light receiving element are mounted, including at least one protrusion thereon, in which the light emitting element and the light receiving element each have a terminal; and the at least one protrusion is configured to support one of the light emitting element and the light receiving element in a contact manner in a state that the terminal is electrically connected to the circuit board.

BRIEF DESCRIPTION OF THE DRAWINGS

Features, embodiments, and advantages of the present invention will become apparent from the following detailed description with reference to the accompanying drawings.

DETAILED DESCRIPTION OF THE PREFERRED EMBODIMENTS

Hereinafter, embodiments of the present invention will be described in detail with reference to the accompanying drawings. Wherever possible, the same reference numbers will be used throughout the drawings to refer to the same or like parts.

First Embodiment

Figure 1:
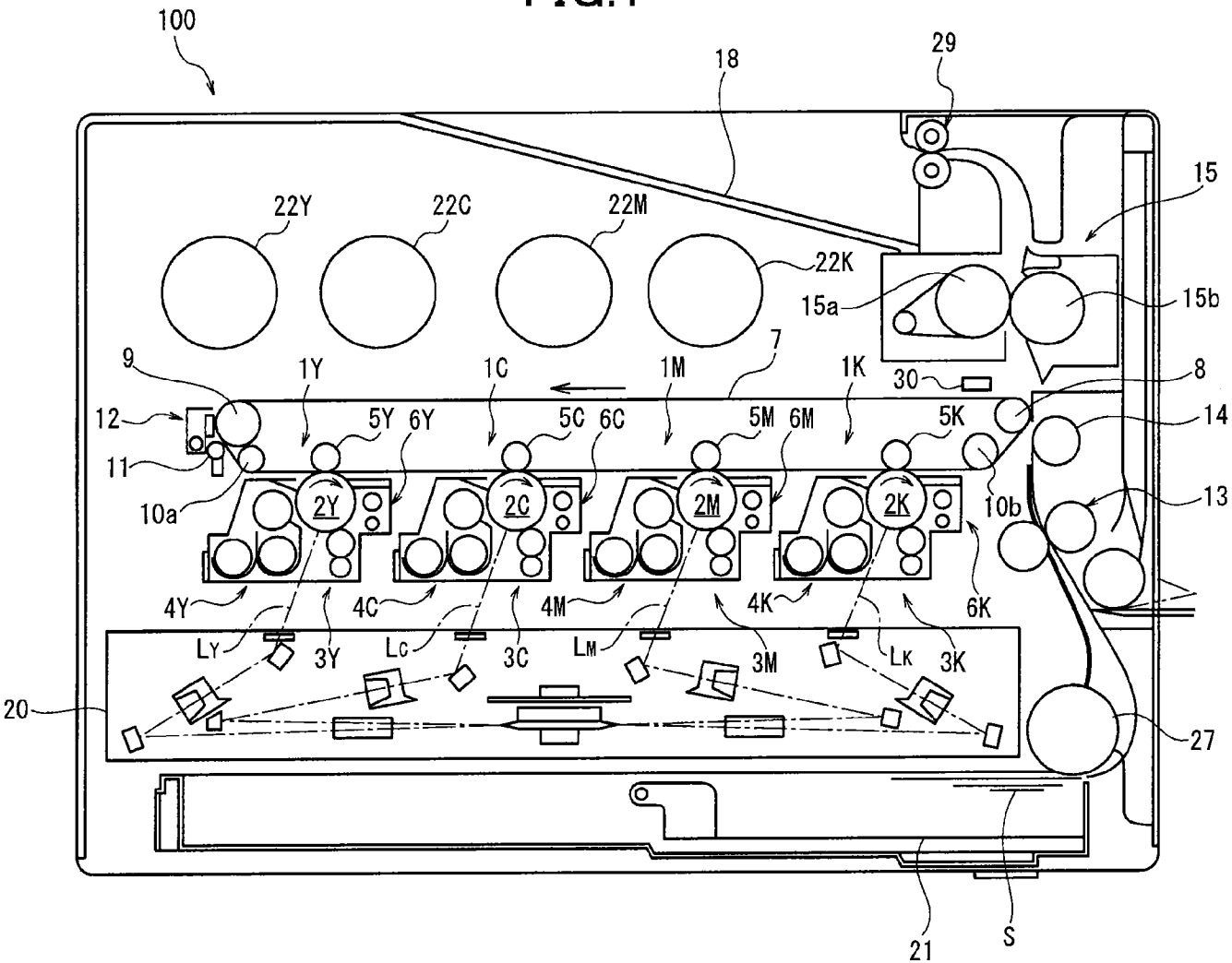
FIG. 1 schematically shows the structure of a printer according to one embodiment of the present invention.

A full color printer 100 (hereinafter, simply printer) as an example of the image forming device according to the present embodiment is described. FIG. 1 schematically shows the structure of the printer 100 which comprises a body containing image forming units 1Y, 1C, 1M, 1K about a center and various elements and a drawer-type paper cassette 21 containing sheets of paper S.

Figure 2:
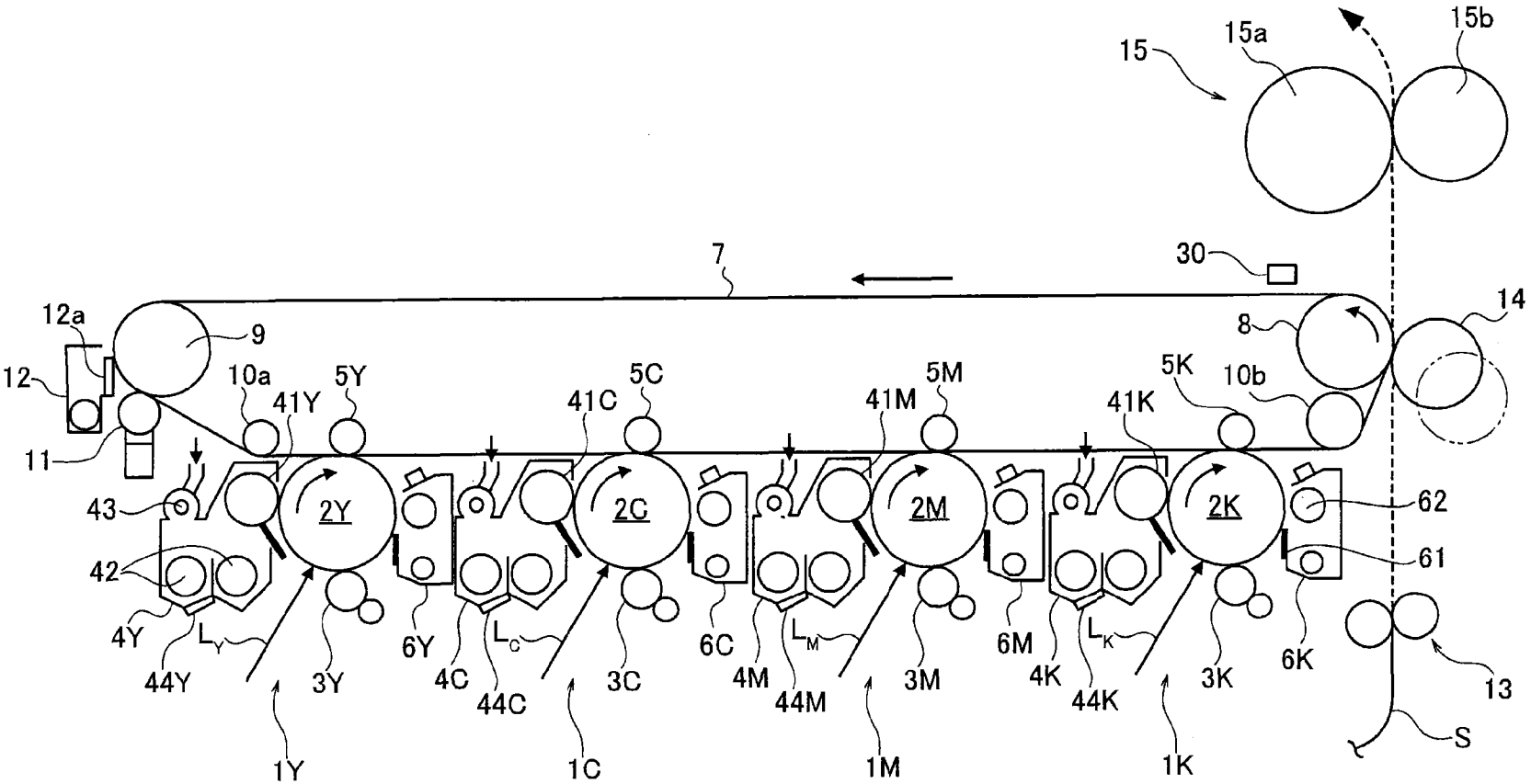
FIG. 2 schematically shows the structure of an imaging forming unit of the printer in FIG. 1.

FIG. 2 schematically shows the structure of the image forming units of the printer 100. Referring to FIGS. 1 to 2, the image forming units 1Y, 1C, 1M, 1K are arranged in this order to face the surface of an intermediate transfer belt 7. The elements given codes ending Y, C, M, K concern yellow, magenta, cyan, and black colors, respectively. The image forming units 1Y, 1C, 1M, 1K with the same structure include photoreceptor drums 2Y, 2C, 2M, 2K, charge rollers 3Y, 3C, 3M, 3K, a laser exposure unit 20, develop units 4Y, 4C, 4M, 4K, and cleaning units 6Y, 6C, 6M, 6K to clean remnant toner from the surfaces of the photoreceptor drums, respectively.

The charge rollers 3Y, 3C, 3M, 3K uniformly charge the photoreceptor drums 2Y, 2C, 2M, 2K with the same polarity (negative in the present embodiment) as that of toner with a predetermined electric potential. Alternatively, various types of charge elements such as a charge brush can be arbitrarily used instead of a charge roller.

The laser exposure unit 20 exposes portions of the photoreceptor drums 2Y, 2C, 2M, 2K between the charge rollers and the develop units. It is disposed in parallel to the rotary axes of the photoreceptor drums 2Y, 2C, 2M, 2K to expose them in main scan direction.

The laser exposure unit 20 includes, for example, a semiconductor laser (LD) as a light source, a coupling system or beam adjusting system made up of a collimate lens or a cylindrical lens, an optical deflector as a polygon mirror, and an imaging system to converge laser beams deflected by the optical deflector on the photoreceptor drums 2. It exposes the surfaces of the photoreceptor drums 2Y, 2C, 2M, 2K with laser beams Ly, Lc, $L_M$, $L_K$ at different intensity on the basis of image data stored in a memory or input from an external device as a PC, to form electrostatic latent images of the four colors thereon. Alternatively, the laser exposure unit 20 can be an LED write unit comprised of an LED array and a lens array.

The bodies of the photoreceptor drums 2Y, 2C, 2M, 2K are each layered with an underlying layer, a charge generating layer, and a charge carrying layer in this order or a reverse order. A known surface protective layer or overcoat layer made from thermoplastic or thermosetting polymer can be additionally layered on the charge generating layer or charge carrying layer, for example. In the present embodiment the bodies of the photoreceptor drums 2Y, 2C, 2M, 2K are grounded.

The develop units 4Y, 4C, 4M, 4K include develop sleeves 41Y, 41C, 41M, 41K made from non-magnetic stainless steel or aluminum which are arranged with a predetermined interval relative to the circumferences of the photoreceptor drums 2 to rotate in the rotary direction of the photoreceptor drums 2. They contain four color one-component or two-component developers. In the present embodiment the develop units 4 contain two-component developer of toner (negative-charged) and magnetic carrier, and magnet rolls with fixed magnets or magnetic poles are provided in the develop sleeves 41. The develop units 4Y, 4C, 4M, 4K further comprise agitation elements 42, supply portions 43 to supply toner from four-color toner bottles 22, and density sensors 44Y, 44C, 44M, 44K to detect the density of toner in the developer when needed.

The develop sleeves 41Y, 41C, 41M, 41K are held by not-shown rollers with a predetermined interval, 100 to 500 μm for example relative to the photoreceptor drums 2Y, 2C, 2M, 2K so as not to contact the surfaces thereof. The develop sleeves are then applied with developing bias of superimposed direct and alternate current voltages to inversely develop the electrostatic latent images on the surfaces of the photoreceptor drums 2Y, 2C, 2M, 2K in contact or non-contact manner and form toner images thereon.

The cleaning units 6Y, 6C, 6M, 6K include cleaning blades 61 contacting the photoreceptors' surfaces and cleaning rollers 62 or brushes, for example.

The intermediate transfer belt 7 as an image carrier is extended over a drive roller 8 doubling as a secondary transfer backup roller, a support roller 9, tension rollers 10*a*, 10*b*, and a backup roller 11 and rotates counterclockwise as indicated by the arrow in FIG. 2. A secondary transfer roller 14 is provided in opposition to the drive roller 8 via the intermediate transfer belt 7. A belt cleaning unit 12 is placed near the support roller 9 so that a cleaning blade 12*a* abuts on the intermediate transfer belt 7. Likewise, the primary transfer rollers 5Y, 5C, 5M, 5K are provided in opposition to the photoreceptor drums 2Y, 2C, 2M, 2K, placing the intermediate transfer belt 7 therebetween. The intermediate transfer belt 7 is driven by the rotation of the drive roller 8 driven by a not-shown motor.

The primary transfer rollers 5Y, 5C, 5M, 5K form transfer areas between the photoreceptor drums 2Y, 2C, 2M, 2K and the intermediate transfer belt 7. Applied with direct current voltage of positive polarity (reverse to the polarity of toner) by a not-shown power source, the primary transfer rollers 5Y, 5C, 5M, 5K form magnetic fields in the transfer areas to transfer the toner images on the photoreceptor drums 2Y, 2C, 2M, 2K to the intermediate transfer belt 7.

The secondary transfer roller 14 opposes the grounded drive roller 8 over the intermediate transfer belt 7 and is applied with direct current voltage of positive polarity to transfer a superimposed toner image on the intermediate transfer belt 7 to a paper sheet S.

The paper sheet S is carried by the feed roller 27 from the paper cassette 21 through a resist roller pair 13 to the intermediate transfer belt 7 held between the secondary transfer roller 14 and the drive roller 8. The toner image is transferred onto the paper sheet S from the intermediate transfer belt 7 in a secondary transfer unit, and then the paper sheet S is carried to a fuser unit 15 to fuse the image by thermal welding of a fuse roller 15*a* and a pressure roller 15*b*, and discharged to a discharge unit 18.

Figure 3:
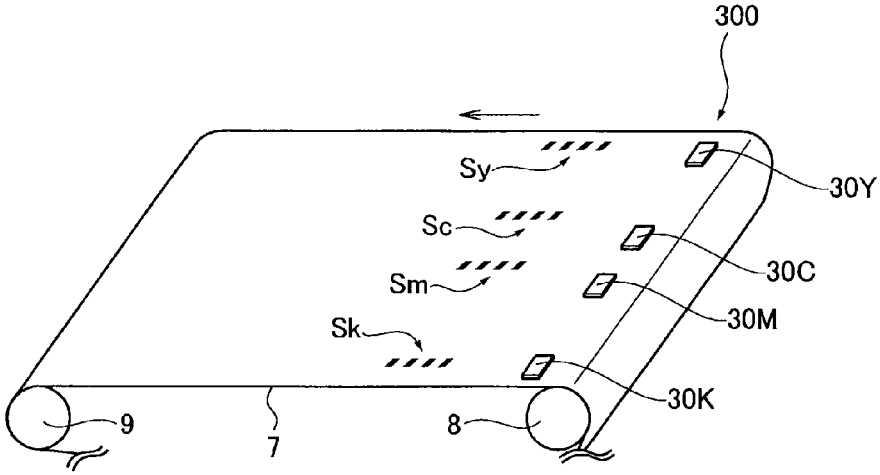
FIG. 3 is an expanded view of the vicinity of an intermediate transfer belt of the printer.

The printer according to the present embodiment includes a controller configured to properly adjust the density of four color images upon power-on or after feeding through a certain number of paper sheets. In image density control the charge bias and developing bias are switched when appropriate to create four-color tone patterns Sy, Sc, Sm, Sk as toner image for density adjustment on the intermediate transfer belt 7, as shown in FIG. 3. The photosensor 30 is placed near the drive roller 18 outside the intermediate transfer belt 7 to detect the toner patterns Sy, Sc, Sm, Sk. The controller is configured to convert the output voltage of the photosensor 30 to attached toner amount to change a developing bias value and a toner density target value as later described. The controller functions as an image density controller in the present embodiment.

A photosensor unit 300 in FIG. 3 includes photosensors 30K, 30M, 30C, 30Y to detect the tone patterns Sk, Sm, Sc, Sy of black, magenta, cyan, yellow, respectively. Hereinafter, the color codes may be omitted when not needed.

Second Embodiment

Figure 4:
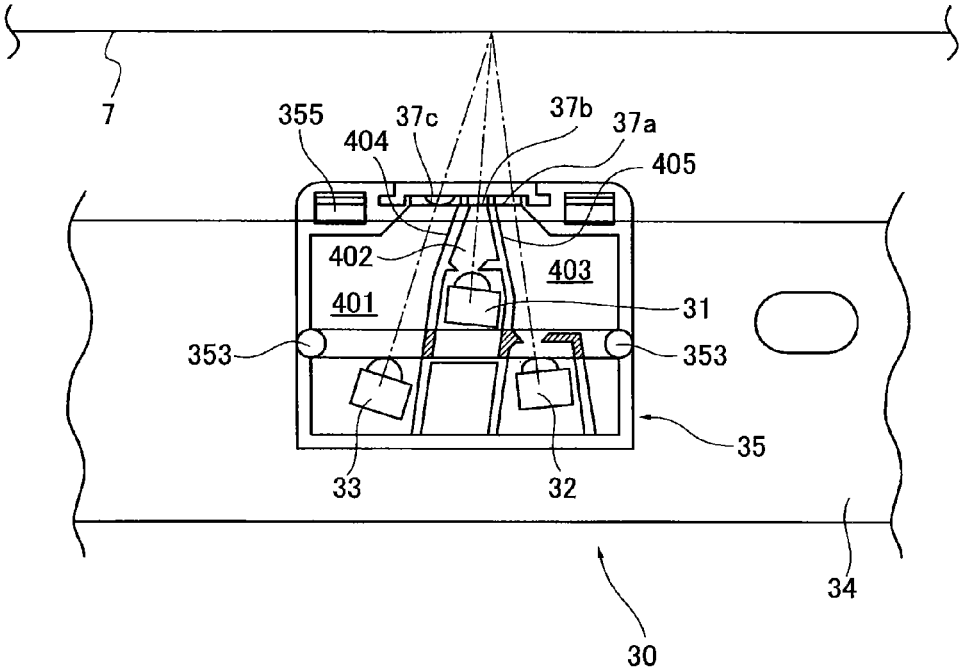
FIG. 4 schematically shows the structure of a photosensor including side view surface mount type light emitting element and light receiving element.

FIG. 4 schematically shows the structure of the photosensor 30 according to the present embodiment. The photosensor 30 includes a light emitting element 31, and first and second light receiving elements 32, 33 of a side view surface mount type which are mounted on the printed circuit board 34 disposed orthogonally to the intermediate transfer belt 7. The elements 31 to 33 are enclosed in a case 35. In the case 35 formed are a passage 402 through which light is emitted from the light emitting element 31 to the intermediate transfer belt 7 or toner images as a target object thereon and passages 401, 403 through which light reflected by the toner images is incident on the first and second light receiving elements 32, 33. Also, shield walls 405, 404 are provided to divide the case 35 into a space including the light emitting element 31 and the passage 402, a space including the first light receiving element 32 and the passage 403, and a space including the second light receiving element 33 and the passage 404. The shield walls 405, 404 function to shield the first light receiving element 32 and the second light receiving element 33 from the light from the light emitting element 31, respectively. A convergence lens 37*b* is disposed on the exit optical path and convergence lenses 37*a*, 37*c* are disposed on the incident optical path.

Figure 5:
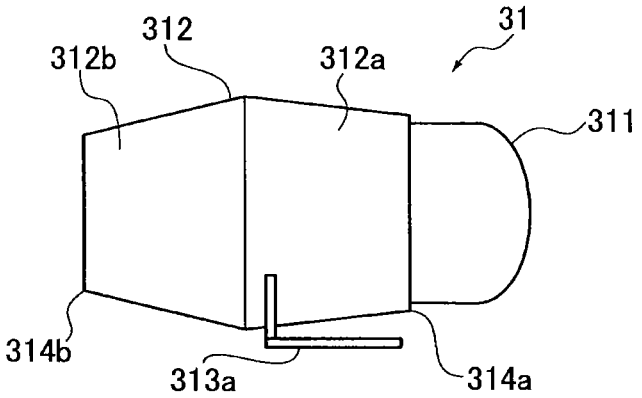
FIG. 5 is a side view of the side view surface mount type light emitting element.
Figure 7:
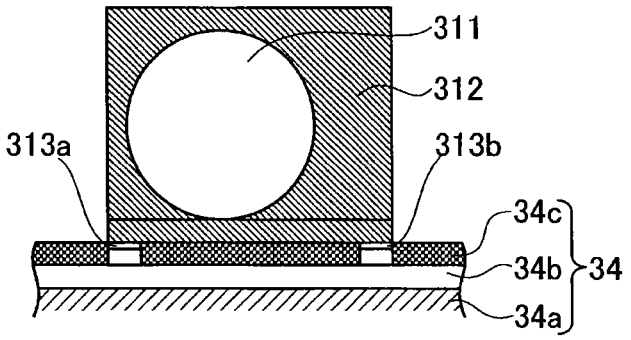
FIG. 7 is a front view of the photosensor in FIG. 6.

The side view surface mount type light emitting and receiving elements 31 to 33 have the same structure so that only the light emitting element 31 is described in the following. FIG. 5 is a side view of the light emitting element 31 including a body 312 made from resin containing a light emitting portion and a lens 311. The body 312 is of a crown shape in which a center portion is more expanded along the optical axis (horizontal direction in the drawing) than the rest of the body. The body 312 is crown-shaped because it is easy to extract it from a mold when formed by injection molding. An output terminal 313*a* and an input terminal 313*b* are provided at both ends of a center portion of the body 312 along the optical axis as shown in FIG. 7. The output and input terminals 313*a*, 313*b* are each comprised of a portion extending below and a portion extending in parallel to the optical axis from the body 312.

Figure 6:
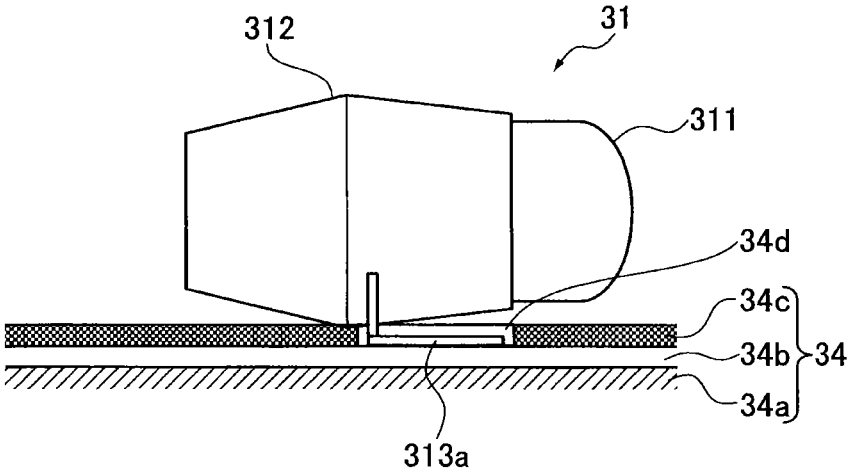
FIG. 6 is a side view of the photosensor in which the side view surface mount type light emitting element is mounted on the printed circuit board.

FIGS. 6 to 7 are a side view and a front view of the light emitting element 31 mounted on the printed circuit board 34, respectively. The printed circuit board 34 includes a base layer 34*a*, a copper foil layer 34*a* of 30 to 40 μm on the base layer, and a resist layer 34*c* of 20 to 40 μm on the copper foil layer. A part of the resist layer 34*c* is removed to expose the copper layer 34*b* and form connecting portions 34*d*. The connecting portions 34*d* are filled with solder with the parallel portions of the terminals 313*a*, 313*b* positioned in the connecting portions 34*d*. Thereby, the light emitting element 31 is fixed on the printed circuit board 34.

Figure 8A:
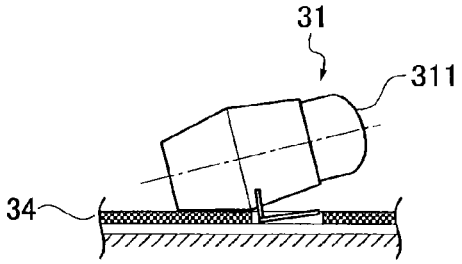
FIGS. 8A, 8B show a photosensor in which a side view surface mount type element is inclined on the printed circuit board, by way of example.
Figure 8B:
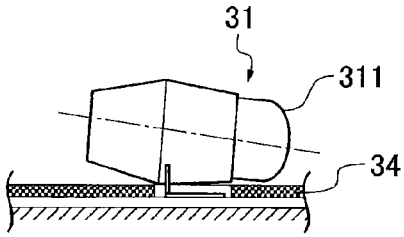

Due to the crown-shaped body 312 of the light emitting element 31, when the output and input terminals 313*a*, 313*b* are placed on the connecting portions 34*d*, a very small gap of several dozen μm occurs between the front (lens side) and rear ends of the body 312 and the printed circuit board 34 as shown in FIG. 6. This may cause the light emitting element 31 to sway about the terminals as a fulcrum and tilt if the light emitting element is accidentally touched in soldering in FIG. 8A. Further, if there is a processing error in the terminal that the angle between the downward extending portion and parallel portion is not the right angle, the light emitting element 31 is inclined relative to the printed circuit board 34 with the parallel portion placed on the connecting portion 34*d*. As a result, the emitting element 31 may be mounted in an inclined posture on the printed circuit board 34. It is possible to hold the light emitting element 31 in a certain posture with a jig while fixing it on the printed circuit board 34 by soldering. However, this makes the mounting work complicated. Similarly, the first and second light receiving elements 32, 33 face the same problems.

Figure 9:
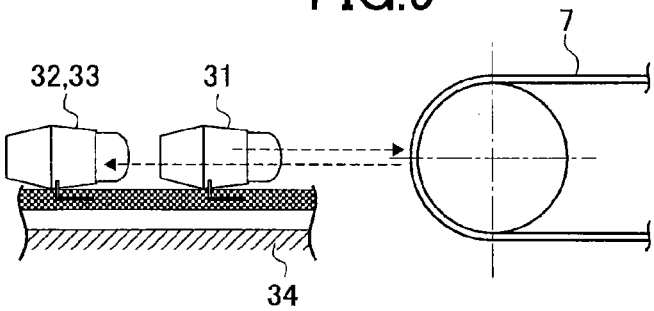
FIG. 9 shows the optical paths of the side view surface mount type element when it is not inclined on the printed circuit board.
Figure 10:
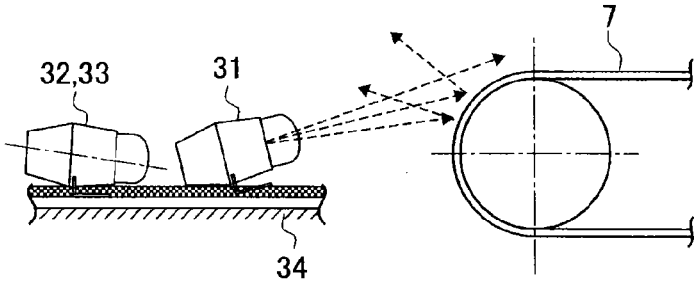
FIG. 10 shows the optical paths of the side view surface mount type element when it is inclined on the printed circuit board.

As shown in FIG. 9, with the elements 31, 32, 33 with no inclination mounted on the printed circuit board 34, the light emitting element 31 can emit light in parallel to the printed circuit board 34 and the first and second light receiving elements 32, 33 can receive light reflected by the intermediate transfer belt 7 in parallel thereto. To the contrary, if the elements 31 to 33 are inclined relative to the circuit board in FIG. 10, the light cannot be emitted in parallel from the light emitting element to irradiate a predetermined position of the intermediate transfer belt 7, and reflected light from the intermediate transfer belt 7 cannot reach the light receiving elements 32, 33. Accordingly, this decreases the accuracy at which a target object is detected.

Figure 11:
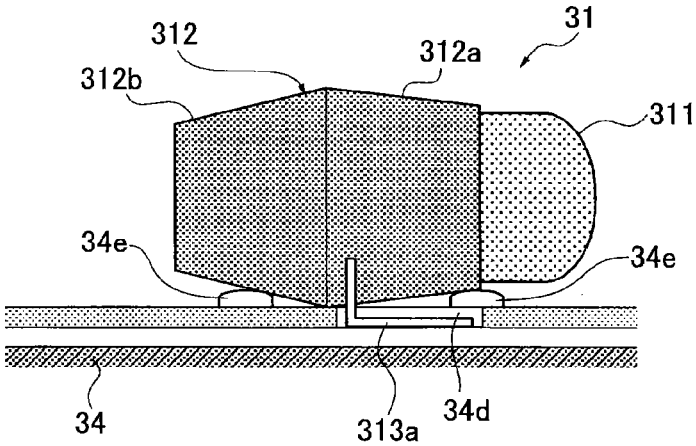
FIG. 11 schematically shows a photosensor including a side view surface mount type light emitting element with a protrusion.
Figure 12:
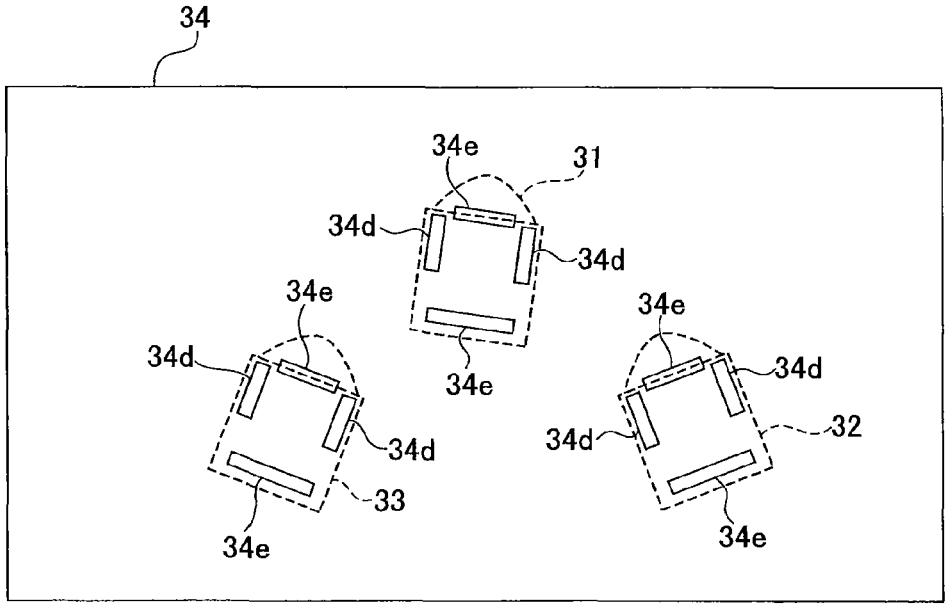
FIG. 12 shows the printed circuit board of the photosensor including protrusions to support the elements.

In view of the above, according to the present embodiment the printed circuit board 34 includes protrusions to support the elements 31 to 33. FIG. 11 schematically shows two protrusions 34*e* on the printed circuit board 34 to support the light emitting element 31. FIG. 12 shows the printed circuit board 34 on which the protrusions 34*e* are provided. In FIG. 11 the protrusions are provided at positions opposing the front (lens side) and back ends of the body 312 of the light emitting element 31. Likewise, two protrusions 34*e* are provided at positions opposing the front and back ends of the bodies of the first and second light receiving elements 32, 33 in FIG. 12. The protrusions are of a long and thin linear shape.

The protrusions 34*e* are formed on the printed circuit board 34 by silk screen printing. Specifically, marks indicating the mount positions of electric elements are formed on the resist layer 34*c* of the printed circuit board 34. The protrusions 34*e* are formed on the resist layer 34*c* by silk screen printing concurrently with the marks. Thus, the protrusions 34*e* can be simply formed.

Figure 13:
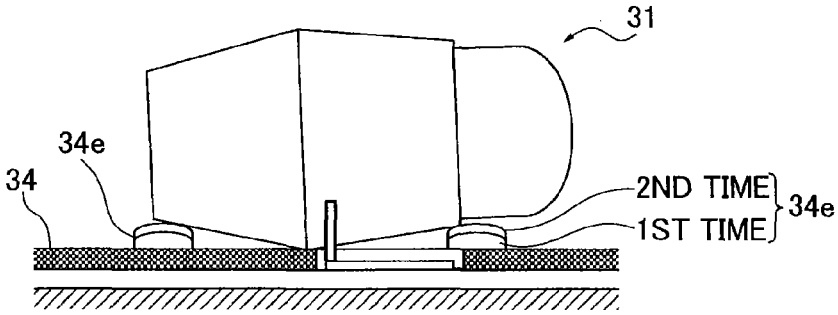
FIG. 13 shows an example in which the protrusion of the photosensor is formed by multiple silk screen printings.

The height of the protrusions 34*e* is 20 to 50 μm. Depending on the element's shape or other factors, the height thereof may not reach a desired height enough to support the element by silk screen printing at once. It is preferable to form the protrusions 34*e* at a desired height by silk screen printing at multiple times as shown in FIG. 13. To properly set the height of the protrusions by silk screen printing at once, the protrusions can be positioned closer to the center of the body portion than those in FIG. 11. However, this is not preferable because the front and back protrusions 34*e* are too close in distance and an error in the height of the two protrusions 34*e* may cause a large inclination of the element.

According to the present embodiment the protrusions 34*e* can sufficiently support the front and back sides of the bodies of the light emitting and receiving elements and prevent them from swaying about the terminals. This prevents the elements from tilting forward or backward along the optical axis even if the elements are accidentally touched while the melted solder filled in between the connecting portions 34*d* and the terminals is hardened. Accordingly, the elements are prevented from being mounted askew on the printed circuit board 34. Further, even with the downward extending portion and parallel portion of the terminal not precisely set at the right angle due to a processing error, the protrusions 34*e* can appropriately support the elements with no inclination on the printed circuit board 34.

Figure 14:
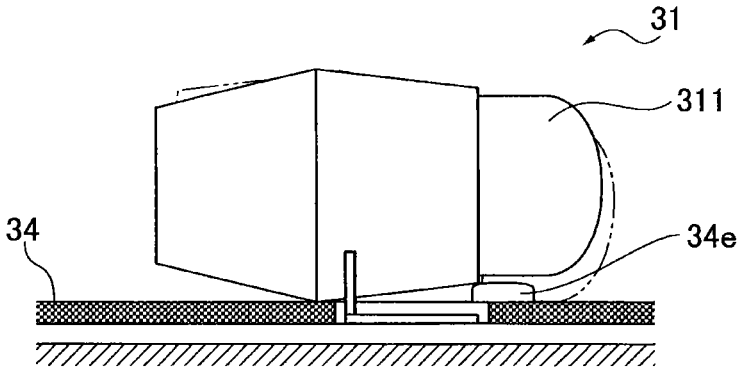
FIG. 14 shows an example of the photosensor including only one protrusion at a position opposite to the front end of an element body.
Figure 15:
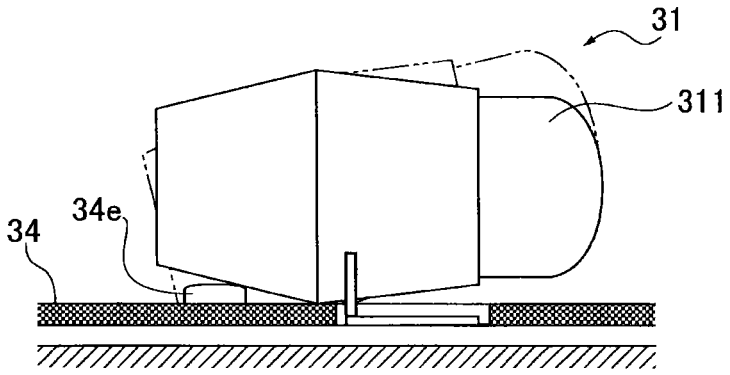
FIG. 15 shows an example of the photosensor including only one protrusion at a position opposite to the rear end of an element body.

Alternatively, for an element with gravity center on the front (lens side), only one protrusion 34*e* instead of two can be provided on the printed circuit board 34 at a position opposing the front end of the body of the element as shown in FIG. 14. In this case the element is supported by the three points, the input terminal, output terminal, and protrusion 34*e*. When this element is hit by some change, the front side is tilted to abut on the printed circuit board 43 as indicated by the broken line in FIG. 14. Therefore, the only one front protrusion 34*e* can sufficiently prevent the element from tilting. Likewise, for an element with gravity center on the rear, the rear side is tilted to abut on the printed circuit board 34 as indicated by the broken line in FIG. 15. One rear protrusion 34*e* can be provided on the printed circuit board 34 at a position opposing the rear end of the body.

Furthermore, the side view mount type light receiving element may receive ambient light reflected by the surface of the printed circuit board. Especially, the ambient light may affect the first light receiving element 32 to receive specularly reflected light from the target object and cause noise therein, resulting in deteriorating the accuracy at which the amount of specularly reflected light is detected. To prevent this, a shield wall 341 in FIG. 16 can be provided at upstream of a traveling direction of the specularly reflected light. In this structure a portion T1 of the light receiving element 32 opposing the shield wall 341 cannot receive the specularly reflected light. If there is a manufacturing error in the height of the front and rear protrusions 34*e* to support the light receiving element 32, the element will be slightly inclined forward. As a result, the size of the portion T1 opposing the shield wall 341 is increased while an area T2 of the element 32 to receive the specularly reflected light is narrowed.

Figure 16:
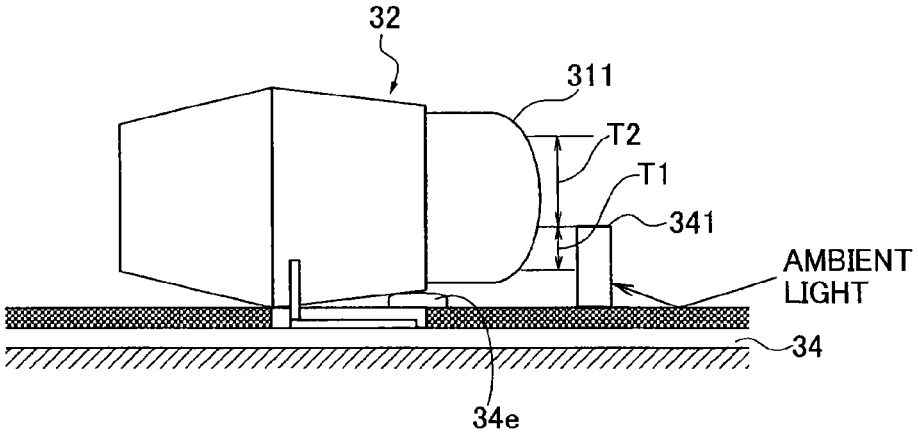
FIG. 16 shows an example of the photosensor comprising a shield wall ahead of the light receiving element.

Therefore, it is preferable to provide only one protrusion 34*e* on the printed circuit board 34 to oppose the front end of the body as shown in FIG. 16. Also, this protrusion 34*e* is preferably set to be higher than the gap between the front end of the body and the printed circuit board. This can prevent the front side of the light receiving element 32 from tilting to the printed circuit board 34 and the area T2 thereof from being narrowed.

Figure 17:
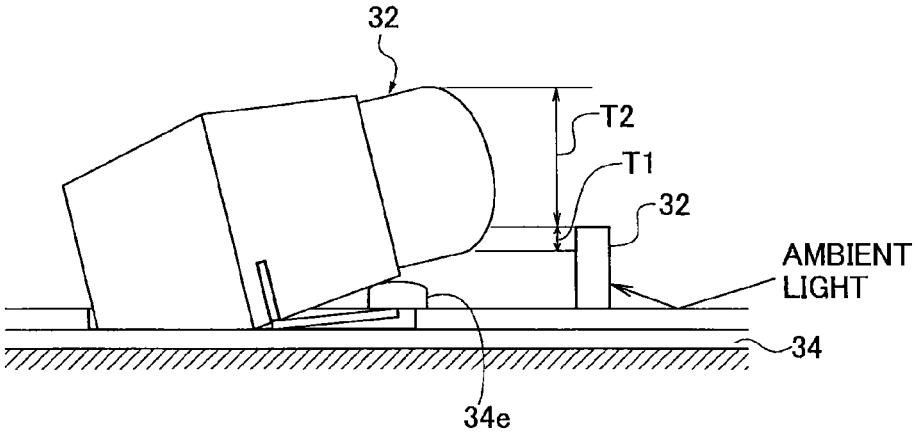
FIG. 17 shows another example of the photosensor comprising a shield wall ahead of the light receiving element.

FIG. 17 shows another example in which the back end of the first light receiving element 32 is inclined to abut on the printed circuit board 34. In this example a part of the resist layer 34*c* is removed so that the rear end of the body of the first light receiving element 32 abuts on the copper foil layer 34*b*. Thus, the first light receiving element 32 is supported on the printed circuit board 34 by the front protrusion and the rear end of the body. Therefore, when fixed on the printed circuit board 34 by soldering, the first light receiving element 32 is prevented from swaying about the terminal and mounted in a certain posture on the circuit board. Alternatively, depending on the inclination angle of the element relative to the printed circuit board 34, the back end of the body can abut on the resist layer or the base layer with the resist layer and copper foil layer removed.

Further, not only the first light receiving element 32 but the light emitting element 31 and the second light receiving element 33 can be mounted on the printed circuit board with the back ends of their bodies abut thereon.

Third Embodiment

Figure 18:
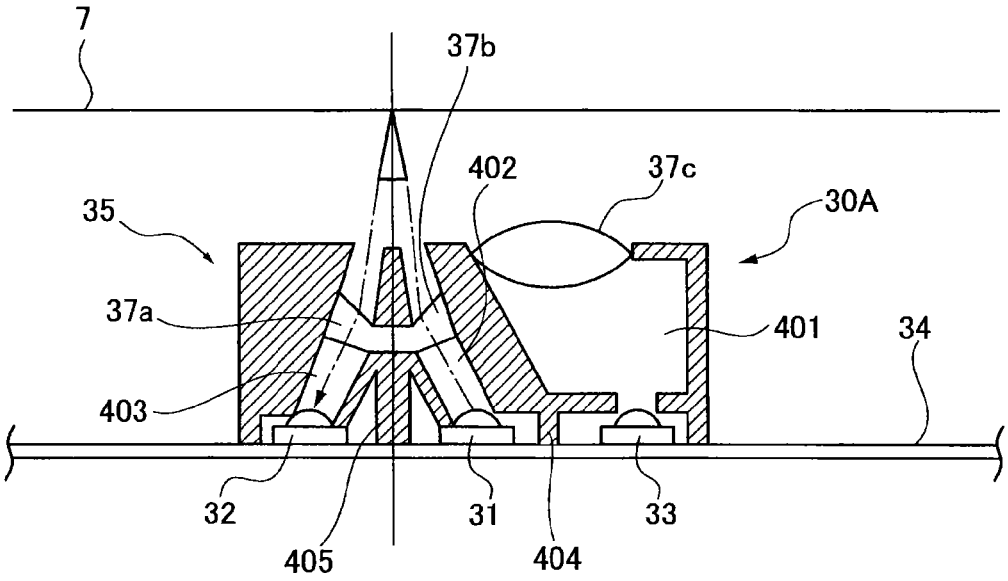
FIG. 18 schematically shows the structure of a photosensor including top view surface mount type light emitting and receiving elements.

Next, an example of a photosensor comprising top view surface mount type light emitting element and light receiving element is described with reference to FIGS. 18 to 25. FIG. 18 schematically shows the structure of a photosensor 30A according to the present embodiment. The photosensor 30A includes a light emitting element 31, and first and second light receiving elements 32, 33 which are mounted on the printed circuit board 34 disposed orthogonally to the intermediate transfer belt 7. The elements 31 to 33 are enclosed in a case 35. In the case 35 formed are a passage 402 through which light is emitted from the light emitting element 31 to the intermediate transfer belt 7 or toner images as a target object thereon and passages 401, 403 through which light reflected by the toner images is incident on the first and second light receiving elements 32, 33. Also, shield walls 405, 404 are provided to divide the case 35 into a space including the light emitting element 31 and the passage 402, a space including the first light receiving element 32 and the passage 403, and a space including the second light receiving element 33 and the passage 404. The shield walls 405, 404 function to reduce the amount of light from the light emitting element 31 from directly entering the first light receiving element 32 and the light receiving element 33, respectively. A convergence lens 37*b* is disposed on the exit optical path and convergence lenses 37*a*, 37*c* are disposed on the incident optical path.

Figure 19:
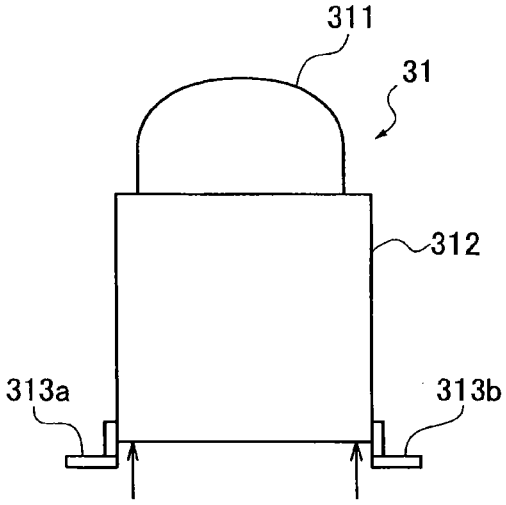
FIG. 19 schematically shows the structure of a top view surface mount type light emitting element.
Figure 20:
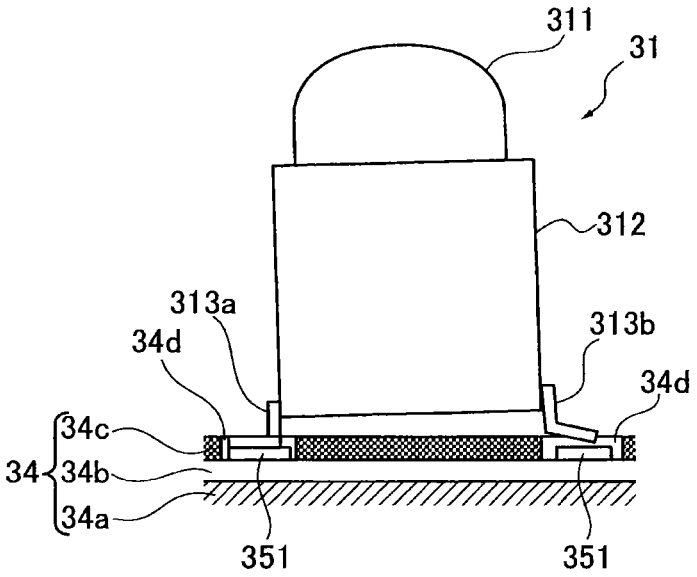
FIG. 20 shows the structure of a top view surface mount type light emitting element on a printed circuit board.

The light emitting and receiving elements 31 to 33 have the same structure so that only the light emitting element 31 is described in the following. FIG. 19 shows the top view mount type light emitting element 31 including a resin body 312 containing a light emitting portion and a lens 311, the same as the side view mount type. The lens 311 is fixed at the top part of the body 312. An output terminal 313*a* and an input terminal 313*b* are provided at right and left bottom ends of the body 312, and each comprised of a portion extending below and a portion extending in parallel to the printed circuit board 34. A part of the resist layer 34*c* is removed to expose the copper layer 34*b* to form connecting portions 34*d*. The light emitting element 31 is fixed on the printed circuit board 34 by positioning the parallel portions of the terminals 313*a*, 313*b* in the connecting portions 34*d* and filling the connecting portions 34*d* with solder 351 (FIG. 20).

The top view surface mount type has the same problem as the side view surface mount type that the element 31 is fixed in an inclined posture on the printed circuit board 34 by soldering if the angles between the downward extending portions and parallel portions of the terminals are not the right angle due to a processing error.

Figure 21:
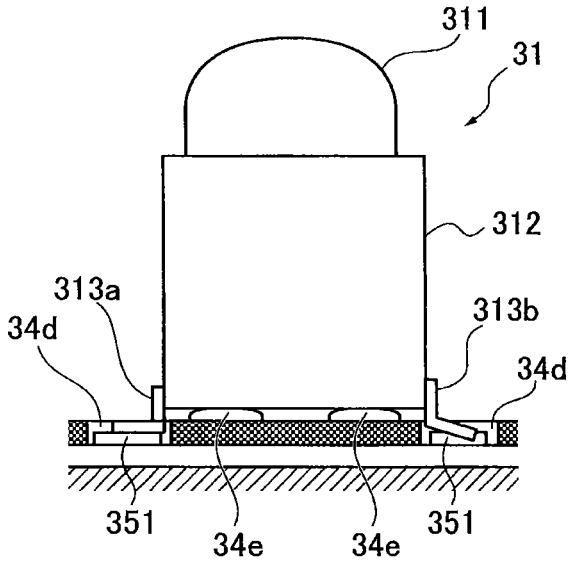
FIG. 21 schematically shows the structure of a top view surface mount type light emitting element with a protrusion.
Figure 22:
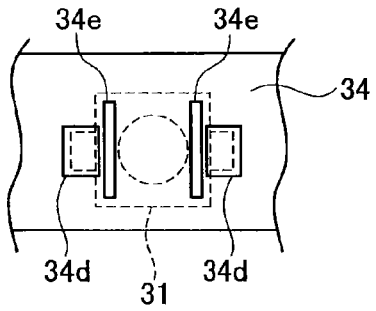
FIG. 22 shows a part of the printed circuit board of the photosensor with the protrusion.

Thus, the photosensor 30A is configured to include two protrusions 34*e* on the printed circuit board 34 at positions opposing the right and left ends of the bottom surface of the element 31 as shown in FIG. 21. The protrusions 34*e* are of a linear shape, extending orthogonally to the parallel portions of the terminals. The height of the protrusions 34*e* is set so that the terminals go up from the copper foil layer 34*b* or the connecting portions 34*d* when they support the element. Specifically, it is set to be over a value obtained by subtracting the thickness of the resist layer 34*c* from the protrusion amount of the terminals from the bottom surface of the element. Thus, in attaching the element 31 to the printed circuit board by soldering, the element is supported by the two protrusions with a predetermined gap between the terminals and the connecting portions 34*d*. Accordingly, the element 31 free from inclination can be supported on the printed circuit board 34 even if the angle between the downward extending portions and the parallel portions of the terminals 313*a*, 313*b* is not the right angle. Then, it is possible to properly fix the top view surface mount element 31 on the printed circuit board 34 by filling the gap between the connecting portions 34*d* and the terminals 313*a*, 313*b* with the solder 351.

Figure 23:
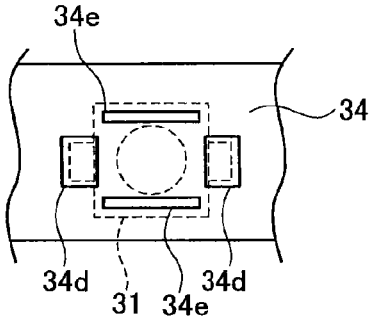
FIG. 23 shows an example of the protrusion of the photosensor.
Figure 24:
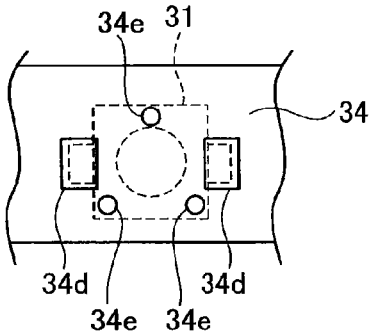
FIG. 24 shows another example of the protrusion of the photosensor.

The height of the protrusions 34*e* is formed to be a predetermined height by silk screen printing at multiple times when it does not reach the height by silk screen printing at once. Further, the linear protrusions 34*e* can extend in parallel to the parallel portions of the terminals as shown in FIG. 23 instead of the ones in FIG. 22 extending orthogonally thereto. Also, the number of protrusions 34*e* can be three and the shape thereof can be columnar as shown in FIG. 24.

Figure 25:
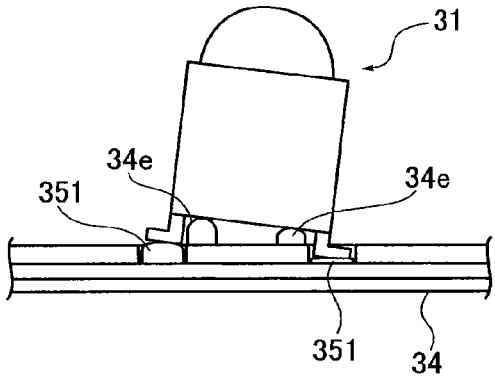
FIG. 25 shows still another example of the protrusion of the photosensor.

Further, the two protrusions 34*e* can be different in height as shown in FIG. 25, for example to incline the posture of the element 31 relative to the printed circuit board 34. Securely supported by the two protrusions 34*e*, the element 31 can be prevented from being fixed on the printed circuit board in an unintended posture.

Instead of attaching the element to the printed circuit board and then filling it with the solder, melted solder can be applied to the connecting portions 34*d* by silk screen printing first and then the element is attached to the printed circuit board, for example. Also, in this case the protrusions can securely support the element in a certain posture on the printed circuit board.

As described above, the photosensor according to any of the above embodiments includes, on the circuit board, one or both of the protrusions to support the light emitting element and/or the light receiving element. By properly forming the shape and height of the protrusions and placing them at the right location, the protrusions can prevent the light emitting and receiving elements from tilting and securely support them in a certain posture on the circuit board, even with the input and output terminals of an unintended shape due to a processing error. Accordingly, compared with the light emitting and receiving elements supported only by the terminals, they can be securely mounted on the circuit board without a change in posture. Moreover, the elements can be prevented from swaying while melted solder filled between the connecting portions and the terminals is hardened.

Further, the image forming device incorporating the above photosensor can properly receive reflected light by a toner image for density adjustment and accurately adjust image density.

Although the present invention has been described in terms of exemplary embodiments, it is not limited thereto. It should be appreciated that variations or modifications may be made in the embodiments described by persons skilled in the art without departing from the scope of the present invention as defined by the following claims.

What is claimed is:

1. A photosensor comprising:

a light emitting element to emit light to a target object;

a light receiving element to receive the light emitted from the light emitting element and reflected by the target object; and a circuit board on which the light emitting element and the light receiving element are mounted, including at least one protrusion thereon, wherein:

the light emitting element and the light receiving element each have a terminal; and the at least one protrusion is configured to support one of the light emitting element and the light receiving element in a contact manner in a state that the terminal is electrically connected to the circuit board, the at least one protrusion provide on the circuit board, and being disposed between the circuit board and said one of the light emitting element and the light receiving element.

2. A photosensor according to claim 1, wherein the protrusion is formed on the circuit board by silk screen printing.

3. A photosensor according to claim 2, wherein the protrusion is formed by silk screen printing at plural times.

4. A photosensor according to claim 1, wherein:

the light emitting element is of a side view surface mount type to emit light in parallel to the circuit board; and the light receiving element is of a side view surface mount type to receive reflected light in parallel to the circuit board, wherein the circuit board includes the protrusion on at least one of a portion opposite to a light emitting surface of the light emitting element, a portion opposite to an opposite surface of the light emitting surface, and a portion opposite to a light receiving surface of the light receiving element, and a portion opposite to an opposite surface of the light receiving surface.

5. A photosensor according to claim 4, further comprising a shield wall on the circuit board at a position more upstream than a position of the light receiving element in a direction of the reflected light, to shield the light receiving element from ambient light reflected by the circuit board, wherein the protrusion is provided on a portion of the circuit board opposite to the light receiving surface of the light receiving element, to support the light receiving element so that a portion of the surface opposite to the light receiving surface abuts on the circuit board.

6. A photosensor according to claim 1, wherein:

the light emitting element is of a top view surface mount type to emit light orthogonally to the circuit board;

the light receiving element is of a top view surface mount type to receive reflected light orthogonally to the circuit board; and a height of the protrusion is set such that the terminal of the one of the light emitting element and the light receiving element supported by the protrusion does not abut on a connecting portion of the circuit board.

7. An image forming device comprising:

an image carrier to hold a toner image on a surface;

the photosensor according to claim 1 to detect light reflected by the toner image; and an image density controller to generate the toner image for density adjustment on the surface of the image carrier and control an image density on the basis of an output value of the photosensor having received light reflected by the toner image for density adjustment.

* * * * *